United States Patent [19]

Ellis et al.

[11] 4,402,091

[45] Sep. 6, 1983

[54] TOILET EVACUATION DEVICE

[76] Inventors: William D. Ellis, 4702 W. Maulding Ave.; Ralla S. Ellis, 4704 W. Maulding Ave., both of Las Vegas, Nev. 89118

[21] Appl. No.: 396,923

[22] Filed: Jul. 9, 1982

[51] Int. Cl.[3] ..... E03D 9/05

[52] U.S. Cl. ..... 4/217

[58] Field of Search ..... 4/216, 217, 209, 213, 4/348, 352

[56] References Cited

U.S. PATENT DOCUMENTS

| | | | |
|---|---|---|---|
| 1,972,076 | 9/1934 | Cross | 4/217 |
| 2,172,506 | 9/1939 | Gerger | 4/217 |
| 2,527,110 | 10/1950 | Wheeler | 4/217 |
| 3,332,089 | 7/1967 | Wilton . | |
| 3,333,285 | 8/1967 | Null | 4/217 |
| 3,763,505 | 10/1973 | Zimmerman . | |
| 3,824,637 | 7/1974 | Hunnicutt, Jr. . | |
| 4,103,370 | 8/1978 | Arnold . | |
| 4,125,906 | 11/1978 | Weiland | 4/213 X |
| 4,200,940 | 5/1980 | Buchanan . | |

*Primary Examiner*—Charles E. Phillips

*Attorney, Agent, or Firm*—Henderson & Sturm

[57] ABSTRACT

This invention relates to toilet seat odor evacuation devices in general, and more specifically to a hollow evacuation member having a plurality of downwardly depending angled apertures disposed around its periphery. In addition, this device is hingedly connected to the water closet adjacent to the tank, so that the device is pivotable, with respect to both the toilet seat, and the toilet bowl. This arrangement therefore allows the external surfaces of the device, surrounding the toilet bowl, to be thoroughly cleaned, thereby eliminating odors and germs.

8 Claims, 3 Drawing Figures

TOILET EVACUATION DEVICE

BACKGROUND OF THE INVENTION

Water closet odor evacuation devices are well recognized by the prior art, as can be seen by reference to the following U.S. Pat. No's. 3,824,637; 3,332,089; 4,103,370; 4,200,940; and 3,763,505. It is also evident from a reading of these patents, that their intended purpose and function is directed to the same common goal, i.e. the reduction, removal, or elimination, of malodorous fumes, gases, or the like co-incident with the bodily functions employed in conjunction with a water closet.

While these prior art devices have performed their stated tasks in an adequate fashion, they have been deficient in the following respects; they have incorporated the evacuation device directly into the water closet structure, either into the bowl or seat, thereby requiring that an entire water closet assembly, or a major component thereof, must be purchased and installed, prior to any benefit being realized by the consumer; they have failed to adequately provide for a baffle means, to prevent urine from entering the suction chamber, either directly, or by virtue of splashing; and finally they have failed to take into account, the fact that microscopic organisms can thrive and propagate in the pores and seams produced by the type of evacuation devices that are permanently secured to either the bowl or the seat.

In summary, there has not been developed until the present time, an evacuation device which is simple, inexpensive, easy to install, substantially reduces or eliminates noxious odors or fumes, provides a surface that is easy to clean, will not promote the growth of micro organisms, and which further is configured to substantially reduce either the direct or indirect entry of urine or other substances into the suction chamber of the device.

SUMMARY OF THE INVENTION

An object of the present invention is the provision of an evacuation ring element for a toilet evacuation device, which is adapted for attachment to the water closet assembly without modifying the assembly components.

Another object of the present invention is the provision of an evacuation ring element which can be connected to a water closet assembly using the same tools that are used to connect the toilet seat to the toilet bowl.

A further object of the present invention is the provision of an evacuation ring element which can be connected to a variety of different remote vacuum sources to effect the evacuation of odors or fumes from the confines of the water closet.

Yet another object of the present invention is the provision of an evacuation ring element, which is hingedly connected to the water closet, and pivotable with respect to both the toilet seat and the toilet bowl, so that substantially the entire exterior surface of the ring element can be cleaned and disinfected.

Still another object of the present invention is the provision of an evacuation ring element, which is provided with an overhanging drip lip and splash guard, that will reduce the effective size of the toilet bowl opening, to confine and contain a larger volume of the noxious fumes within the bowl, whereby a greater percentage of the offending odors will be removed by a source of vacuum.

A still further object of the present invention is the provision of a plurality of evacuation apertures, disposed around the periphery of the underside of the evacuation ring element, in such a manner as to virtually eliminate the direct entry of liquid contaminents into the interior of the device, while insuring that the maximum volume of gaseous contaminants pass through the device.

These and other objects, advantages and novel features of the invention will become apparent, from the detailed description which follows, when considered in conjunction with the accompanying drawings.

DETAILED DESCRIPTION OF THE PREFERRED EMBODIMENT

Figure 1:
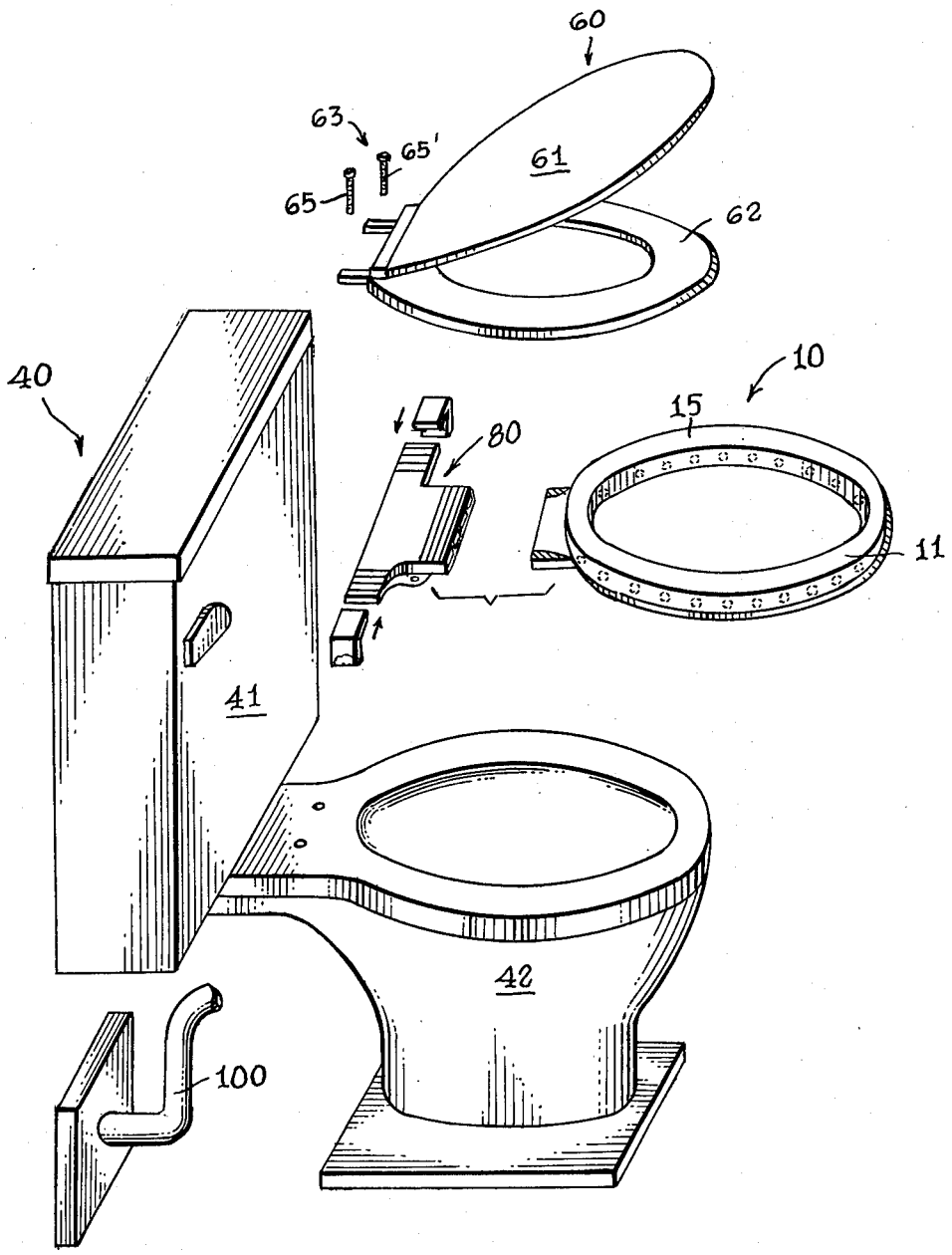
FIG. 1, is an exploded perspective view of the improved evacuation ring device as it would be installed on a water closet.

As can be seen by reference to FIG. 1, the improved evacuation ring device, which forms the present invention is designated generally as 10, and is intended for use with any standard water closet assembly 40, and its associated closure assembly 60.

The water closet assembly 40, comprises a water tank 41, and a toilet bowl stanchion 42, connected to plumbing fixtures (not shown). The closure assembly 60, comprises a lid element 61 hingedly connected to seat element 62, which is pivotally connected to a means for fastening the closure assembly 60 to the water closet assembly 40.

The fastening means 63, are adapted to cooperate with a pair of apertured lip members 64, and comprise a nut and bolt 65, 65' to secure the closure assembly 60 to the stanchion 42, in a well recognized manner.

As shown in FIG. 1, the evacuation ring device 10, is intended for use as an intermediate sealing member between the toilet bowl stanchion 42, and the closure assembly 60. The evacuation ring device 10, comprises a main ring member 11, and a vacuum base member 80, both of which are hollow over selected portions of their interior to provide open fluid communication between the interior of the toilet bowl and an external source of vacuum.

Referring now specifically to the vacuum base member 80, as can best be seen by reference to FIG. 2, this member has a generally T-shaped configuration with the hollow base of the T forming the primary vacuum port (in phantom) and the hollow arms of the T forming the right hand and left hand vacuum ports, whose purpose and function will be discussed further on in the specification.

The vacuum base member 80 is further provided with flanges 84 on each side of the hollow base of the T shaped member, having apertures 85, which are dimensioned to receive the fastening means 63, used to secure the closure assembly 60 to the water closet assembly 40.

In order to accommodate the evacuation ring device 10, to stanchions having varing lengths; the base of the T is provided with a plurality of scored segments 86, on its outboard end, which may be separated from the vacuum base member 80, to shorten it's length, prior to connecting the main ring member 11, to the base member 80, in any one of a number of suitable ways to form the evacuation ring device 10.

The right and left hand arms of the T are likewise scored; however, this is done for somewhat different reasons. Since the vacuum source may be installed on either side of the water closet assembly for aesthetic or other practical reasons, the vacuum base member 80, must be adapted, so that it can be connected to the source of vacuum on either the right hand or left hand side. To this end, the outboard ends of the arms of the T are provided with scored segments 82' and 83', which may be selectively removed from the vacuum base assembly prior to connecting the evacuation ring device to the vacuum source.

The purpose of this selective removal of the segments 82' and 83' is to allow the vacuum base member 80, to be foreshortened on either end, depending on the position of the vacuum source. In addition, the device is further provided with a plugged cap member 90' and a hollow cap member 90, which are adapted to be secured to either the right hand or left hand arms of the vacuum base member 80. The plugged cap member 90' will close off the end of whichever arm member it is secured to; and the hollow cap member 90 will leave open the auxiliary vacuum port, of whichever arm it is secured to.

By now it should be obvious that either arm of the vacuum base member can be connected to the source of vacuum, while the other arm is plugged, so that the source of vacuum is in open communication with the primary vacuum port, in the vacuum base member 80. The vacuum base member 80 is in turn connected to the hollow interior of the main ring member 11, as will be seen by a further reading of the specification.

The main ring member 11, comprises a generally circular hollow ring body 15, formed of an impervious material such as rubber, plastic or teflon, which provides a smooth external surface, which can be easily cleaned, thereby removing odor causing micro-organisms, and other contaminants. It is crucial to this invention, that the external surface of the main ring member be a smooth, continuous surface, not only for aesthetic considerations, but also because a surface having these characteristics will not be conducive to the propagation of micro-organisms; which can thrive in small cracks, fissures, recesses, etc.

Figure 3:
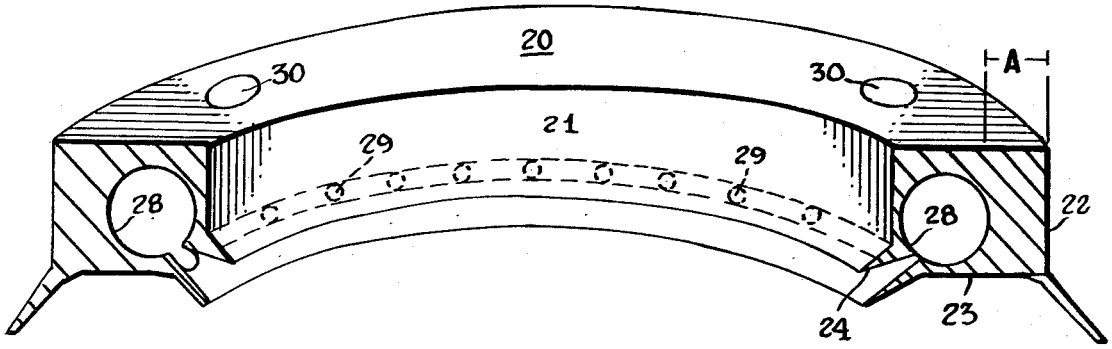
FIG. 3, is a cross-sectional view of the evacuation ring, illustrating the relationship between the internal vacuum port and the evacuation apertures.

As can best be seen by reference to FIG. 3, the hollow ring body 15 is provided with a flat upper surface 20, side walls 21,22, and a contoured bottom surface 23. The hollow ring body 15, is generally rectangular in cross-section; however, it has a downwardly projecting interior lip portion 24, which is formed by the outwardly flared lower edge of the interior wall 21, and the downwardly flared interior edge of the contoured bottom surface 23. As shown in FIG. 3, the outer lower periphery of the ring body may be provided with a tapered extension; however, this structure is for aesthetic purposes only, and does not contribute to the actual functioning of the device. The interior lip portion 24, on the other hand, does play an important role in the operation of the device, as will be explained in detail.

Figure 2:
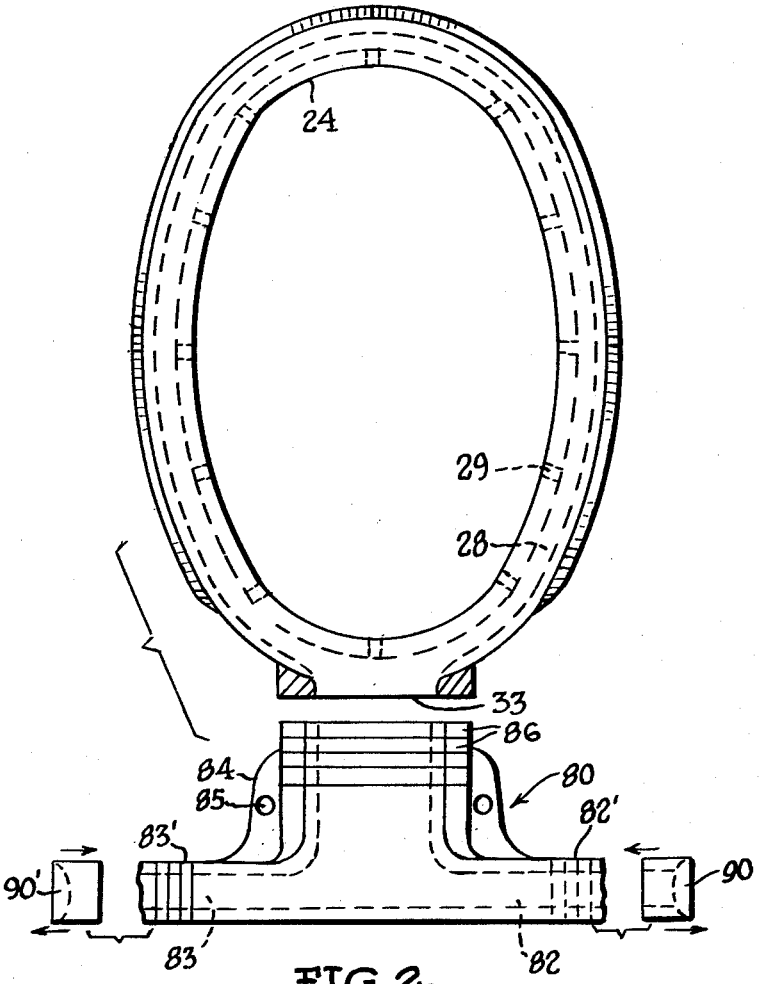
FIG. 2, is a bottom plan view of the evacuation ring device, illustrating the disposition of the evacuation apertures around the inner periphery of the ring.

Referring now to both FIGS. 2 and 3, it can be seen that the hollow body 15 is provided with an enlarged, internal vacuum port 28, which is off-set with respect to the centerline of the ring body, is disposed proximate the interior wall 21, and extends completely around the ring body 15. A plurality of tubular evacuation apertures 29, are formed in the downwardly depending lip portion 23 of the ring body, and are in direct communication with the internal vacuum port 28.

There are several reason why the internal vacuum port 28, is disposed adjacent to the interior wall 21; the first of which, is of that the vacuum port is disposed almost directly over the tubular evacuation apertures 29. The second reason for this construction, is to provide an enlarged weight bearing surface A, on the outer periphery of the hollow ring body, which will prevent the vacuum port 28, from being compressed, or collapsed. This weight bearing surface also provides a surface to accommodate a plurality of shallow recesses 80 to accommodate the downwardly projecting toilet seat support member (not shown) in the upper surface 20 of the ring body 15.

While the hollow ring body 15, may be circular or oval in configuration, in order to coincide with the configuration of the bowl opening; it should be apparent that the interior opening of the hollow ring body must be less than the bowl opening, so that the lip portion 24, will project inwardly and downwardly, into the bowl opening. The lip portion 24, therefore, reduces the effective bowl opening, to further confine liquid and gases within the bowl. Given the face that the lip and its associated tubular apertures project downwardly and inwardly into the bowl, it should be obvious that liquid cannot enter the tubular apertures directly from above, and can only enter from below the rim at an acute angle, there by virtually eliminating the possibility of liquid contamination inside the hollow ring body.

Since the evacuation device is intended for use with an external vacuum source 100, an external vacuum port 33, is provided at the rearward portion of the hollow ring body. This external vacuum port is adapted to be connected to the vacuum base number 80, which will place the interior of the toilet bowl into open communication with the source of vacuum, through the interior vacuum port and evacuation apertures, in a well recognized manner.

Since the upper surface of the hollow ring body is configured to form a seal with the bottom of the toilet seat, and the bottom surface of the ring body is configured to form a seal with the top of the toilet bowl, all of the expelled gases must pass through the opening formed by the inner periphery of the ring body. Therefore, when the external vacuum source is actuated, the noxious gases with the bowl will be drawn up into tubular apertures around the depending lip portion, to remove the objectionable odors from the atmosphere.

Again, it should be noted that the downwardly depending, tubular apertures are disposed at an acute angle to prevent liquids from entering directly into the interior of the hollow ring body. In the preferred embodiment illustrated in FIGS. 1–3, this angle is depicted as approximately 45°; however, any angle less than 45° would be acceptable, as long as the angle prevents direct vertical entry of liquid into the enlarged vacuum port, from the underside of the hollow ring body.

Having thereby described the subject matter of this invention, it should be obvious that many substitutions, modifications and variations of the device are possible in light of the above teachings. It is therefore be understood, that the invention as taught and described is only to be limited to the extent of the breadth and scope of the append claims.

What we claim is:

1. In combination with a water closet assembly including a toilet bowl and a hinged seat, an improved evacuation ring device adapted to be connected to an external vacuum source wherein the evacuation ring comprises;

a generally circular hollow ring body having an upper surface configured to form a seal with the bottom of the hinged seat, a bottom surface which is configured to form a seal with the top of the toilet bowl and a downwardly depending lip portion which extends inside the ring of the bowl, wherein the downwardly depending lip portion is provided with a plurality of tubular evacuation apertures which are in open communication with said external vacuum source, and a hollow T-Shaped vacuum base member connected to, and intermediate, said hollow ring body and said source of vacuum; wherein the hollow base of the T-shaped member forms a primary vacuum port; and the hollow arms of the T-shaped member form auxiliary vacuum ports, wherein the T-shaped vacuum base member is provided with a plurality of scored segments on all of its ends, and said scored segments may be selectively removed to foreshorten any portion.

2. An improved evacuation ring device as in claim 1; wherein, said hollow ring body is further provided with an enlarged vacuum port, which is off-set with respect to the centerline of the ring body, disposed proximate the interior wall of the ring body, and above said plurality of tubular evacuation apertures.

3. An improved evacuation ring device as in claim 2; wherein, said hollow ring body is further provided with an external vacuum port on its rearward end, which is adapted to be connected to an external source of vacuum, to establish fluid communication between the tubular apertures and said vacuum source through said enlarged vacuum port.

4. An improved evacuation ring device as in claim 1; wherein, the upper surface of said hollow ring body is further provided with a plurality of recesses dimensioned to accommodate depending projections on said toilet seat.

5. An improved evacuation ring device as in claim 1; wherein, said hollow ring body is fabricated from rubber.

6. An improved evacuation ring device as in claim 1; wherein, said hollow ring body is fabricated from plastic.

7. An improved evacuation ring device as in claim 1; wherein, said hollow ring body is fabricated from TEFLON.

8. An improved evacuation ring device as in claim 1; further comprising, a hollow cap member adapted to be secured to one of the arms of the T-shaped vacuum base member, and a a plugged cap member adapted to be secured to the other arm of the T-shaped vacuum base member.

* * * * *